US007344028B2

(12) United States Patent
Hanson

(10) Patent No.: US 7,344,028 B2
(45) Date of Patent: Mar. 18, 2008

(54) INSULATED TOTE FOR BEVERAGE BOX

(75) Inventor: Ann Hanson, Ionia, MI (US)

(73) Assignee: Igloo Products Corporation, Katy, TX (US)

( * ) Notice: Subject to any disclaimer, the term of this patent is extended or adjusted under 35 U.S.C. 154(b) by 812 days.

(21) Appl. No.: 10/855,632

(22) Filed: May 28, 2004

(65) Prior Publication Data

US 2005/0263432 A1 Dec. 1, 2005

(51) Int. Cl.
*B65D 81/38* (2006.01)

(52) U.S. Cl. ..... 206/545; 62/457.5; 224/148.7; 206/549; 220/592.17

(58) Field of Classification Search ..... 206/545, 206/549; 62/457.3, 457.4, 457.5; 220/592.17; 224/148.7

See application file for complete search history.

(56) References Cited

U.S. PATENT DOCUMENTS 3,262,283 A * 7/1966 Taylor ..... 62/372
4,721,237 A * 1/1988 Leslie ..... 224/148.3
4,858,444 A 8/1989 Scott
4,887,751 A * 12/1989 Lehman ..... 224/579
5,007,250 A * 4/1991 Musielak ..... 62/372
D371,942 S * 7/1996 Lippincott et al. ..... D7/607
6,109,059 A * 8/2000 Lebrun ..... 62/457.5
2003/0080133 A1* 5/2003 Butler ..... 220/592.2
2004/0074936 A1* 4/2004 McDonald ..... 224/148.5

* cited by examiner

*Primary Examiner*—Mickey Yu
*Assistant Examiner*—Jerrold Johnson
(74) *Attorney, Agent, or Firm*—King & Spalding LLP

(57) ABSTRACT

A portable tote is provided which has flexible, insulating walls to insulate the contents of the tote from the environment and maintain e.g., a reduced temperature of its contents. The tote is configured to receive a beverage box, in particular, an elongated twelve pack box. An end wall access flap provides selective access to the contents of the tote, such as the twelve ounce beverage cans contained in the beverage box. An asymmetric handle strap can be used to support the tote in a stable manner.

22 Claims, 6 Drawing Sheets

INSULATED TOTE FOR BEVERAGE BOX

BACKGROUND AND SUMMARY OF THE INVENTION

The present invention relates to portable, insulated containers and more particularly to an insulated tote particularly adapted for storing containerized drinks.

Insulated containers have been developed for storing a variety of food and drink products, particularly where these products need to be kept cool or warm for a prolonged period. Some insulated containers have been developed to accommodate a so-called six pack of twelve ounce cans, generally in the upright position. While such coolers are convenient to the consumer, twelve packs of sodas have become increasingly popular. In particular, an elongated twelve pack beverage box, marketed as the FRIDGE PACK, has been developed. This elongated twelve pack beverage box has a partly removable end wall to provide access to the beverages disposed within it. Advantagely, the box can be easily disposed on a refrigerator shelf in a can dispensing position. Should the consumer wish to transport the chilled beverage cans, however, he must either place the box in a much larger cooler/ice chest, or the cans must be removed from the box before transport.

The invention provides an insulated tote which is adapted in particular to receive an elongated twelve pack beverage box so that the beverages can be purchased in the twelve pack box, placed in a refrigerator for initial cooling, and then transported in the tote provided in accordance with the invention, to maintain the chilled temperature of the beverage cans. The tote provided in accordance with preferred embodiments of the invention further includes an end access door so that chilled beverage cans may be removed individually from the beverage box without removing the beverage box from the tote and without unduly comprising the insulating characteristics of the tote.

In accordance with a further feature of the invention, a flexible strap is provided for suspending and transporting an elongated tote. In an exemplary embodiment, the strap is eccentrically mounted to the tote so that a stable support of the elongated tote is facilitated.

Although the tote may be a hard sided container, in an exemplary embodiment, the elongated tote of the invention is formed with generally flexible insulating walls as a so-called soft-sided cooler, so that it is lightweight and can be reduced in size or even flattened for storage.

Thus, the invention may be embodied in an insulated container comprising: insulated side and end wall panels; a bottom wall panel; and a top wall panel, said top panel being secured to at least one of said side and end wall panels, said side, end, top and bottom end wall panels defining an insulated enclosure volume therebetween, at least a portion of said top wall panel being displaceable with respect to a top edge of said side and end wall panels as a lid panel to provide selective access to said insulated enclosure volume, wherein a length of said side wall panels is at least about 2½ times a width of said end wall panels and at least about 2½ times a height thereof.

In accordance with a further feature of the invention, the lid panel has a length generally corresponding to said length of said side wall panels and a width generally corresponding to a width of said end wall panels.

The invention may also be embodied in an insulated container comprising insulated front, rear and end panels, a bottom panel and a top panel detachably secured to at least one of said front, rear, and side panels, said panels defining an insulated enclosure volume therebetween, said top panel being displaceable with respect to a top edge of said front, rear, and end panels to provide selective access to said insulated enclosure volume, a carrying strap having first and second longitudinal ends, said first longitudinal end being secured to said front panel and said second longitudinal end being secured to said rear panel, said first and second longitudinal ends being offset from one another along a longitudinal axis of said cooler so that said longitudinal ends are each laterally offset from a plane perpendicular to and passing through a longitudinal midpoint of said front and rear panels.

BRIEF DESCRIPTION OF THE DRAWINGS

These and other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
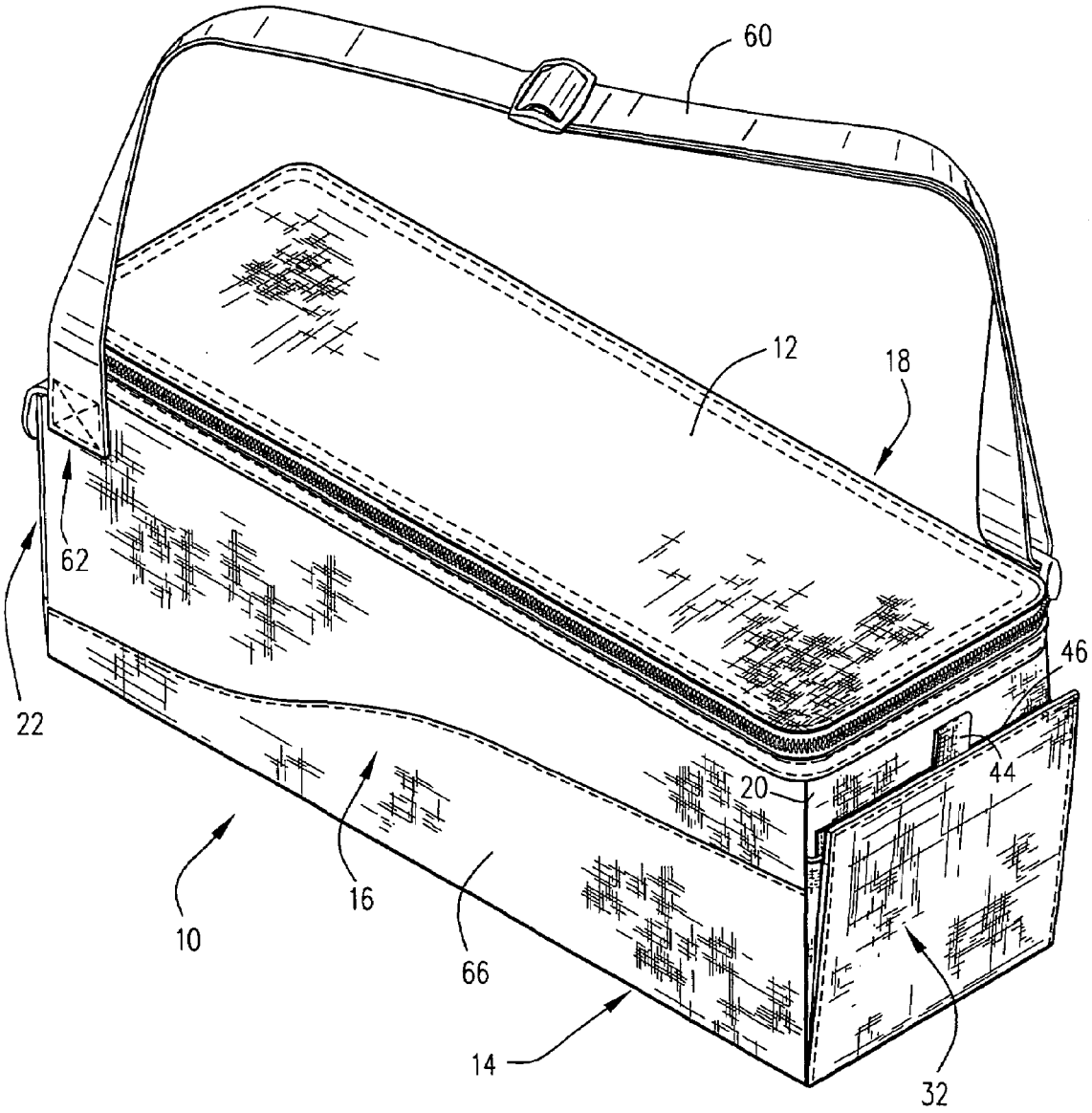
FIG. 1 is a perspective view from the front, right and above of the insulated tote provided in accordance with an embodiment of the invention.

An exemplary embodiment of an insulated tote 10 embodying the invention is shown in FIG. 1. The tote 10 includes a top wall panel 12, a bottom wall panel 14 (not shown in detail), front and rear side wall panels 16,18 and first and second (or right and left) end wall panels 20,22. As will be understood, terms such as front, rear, first, second, right, left, side, and end are used herein for convenience of description only and are not to be considered limiting of the transporting and/or use orientation of the tote and/or access door or pocket location. In a presently preferred embodiment, at least the top, side and end wall panels are formed from a flexible material, for example nylon outer and flexible plastic inner layers or shells and an insulating foam interior. In the alternative, the inventive tote may be embodied as a hard-sided cooler. In either case, the inner shell of the insulated tote is preferably substantially water tight so that it will not leak even in the event of rupture of a beverage container disposed therewithin.

Figure 2:
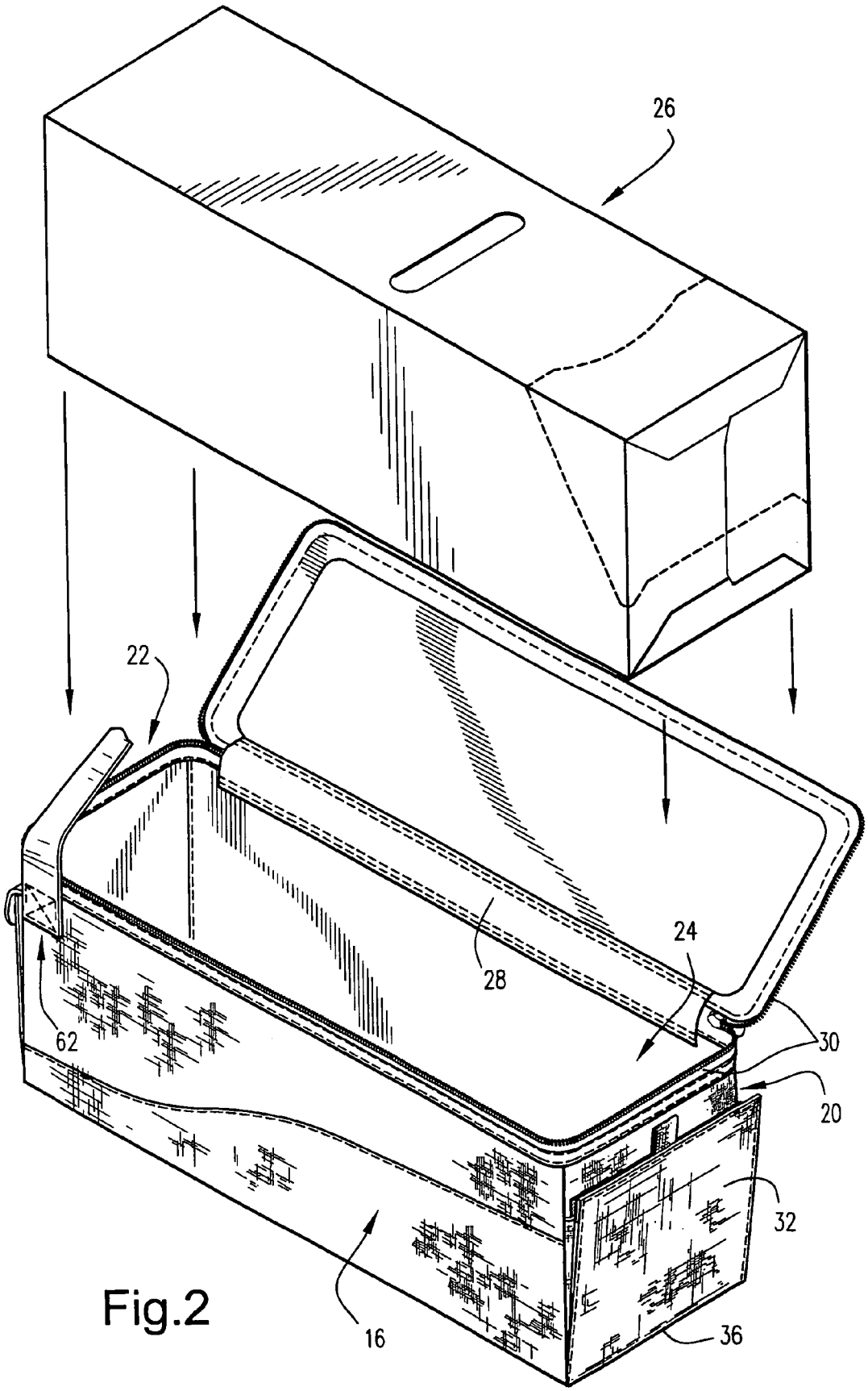
FIG. 2 is an exploded perspective view showing a beverage box disposed for placement in the tote.

The walls 12,14,16,18,20,22 together define an insulated enclosure volume generally designated at 24 in FIG. 2. In the illustrated embodiment this volume is adapted to receive an elongated twelve pack box of twelve ounce cans generically referred to as beverage box 26. It is to be understood, however, that as presently proposed, the tote of the invention could receive two six packs respectively disposed upright or on a side, two six pack boxes, or other foods and beverages whether or not contained within a box. Furthermore, although the illustrated tote is adapted in particular to receive and maintain the temperature of food and/or beverage products, the tote may be used, in addition or in the alternative, to receive and transport other, non-edible products.

In the illustrated embodiment, the top wall panel 12 is provided as a substantially continuous, unitary lid panel that is hingedly attached to the rear wall 16 of the tote. Thus, a flexible hinge panel 28 is provided in the illustrated embodiment respectively fastened, as by stitching or other temporary or permanent fastener, to secure the top panel or lid 12 to the rear wall 16. It is to be understood, however, that the material comprising the lid 12 could be integrally provided with the rear wall 16 of the tote and/or the lid 12 could be provided as a plurality of lid parts without departing from the invention.

The top panel 12 is secured with a suitable fastener to the top edge of at least the front side wall 16 and preferably also the right and left end walls 20,22. In the illustrated embodiment, a zipper fastener 30 is provided to close and secure the top panel or lid 12 with respect to the front, right, and left walls 16,20,22 of the tote, to selectively provide full and open access to the enclosure volume 24 as illustrated in FIG. 2. As an alternative to zipper fastener 30, the lid can include a front and/or end flaps and be secured to the respective side or end walls with Velcro-type fasteners, snaps, magnet fasteners, or other similar detachable fasteners.

To accommodate the elongated beverage box 26, in accordance with the preferred embodiment of the invention, the tote has a length that is substantially greater than its width and height dimensions. More specifically, in the illustrated embodiment, the tote has a length that is about 2½ to 3½ times its width. By way of example, an elongated twelve pack beverage box currently available has a width of about 5 inches and a length of about 15½ inches. A soft-sided beverage tote having a width of about 5 to 6 inches and a length of about 15½ to 16½ inches will closely receive the elongated twelve pack without hindering its insertion or removal from the tote 10. The height of the tote may vary but most preferably is adapted to receive the twelve pack beverage box which has a height of about 5¼ inches such that a height of e.g., about 5½ to 7½ inches will well accommodate the beverage box.

Figure 3:
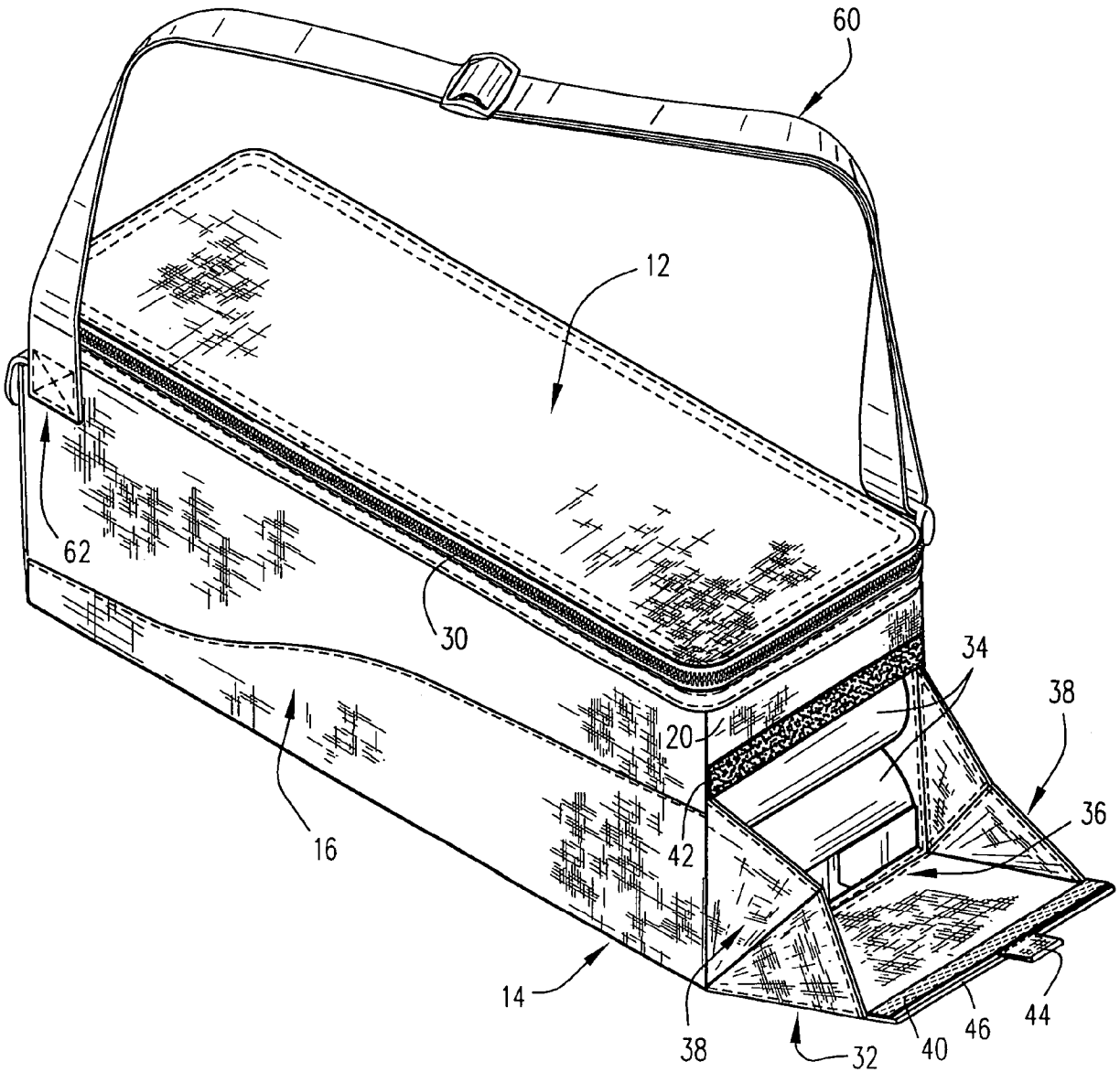
FIG. 3 is a perspective view similar to FIG. 1, showing a first embodiment of a beverage access flap, open for selective removable of a beverage can.
Figure 4:
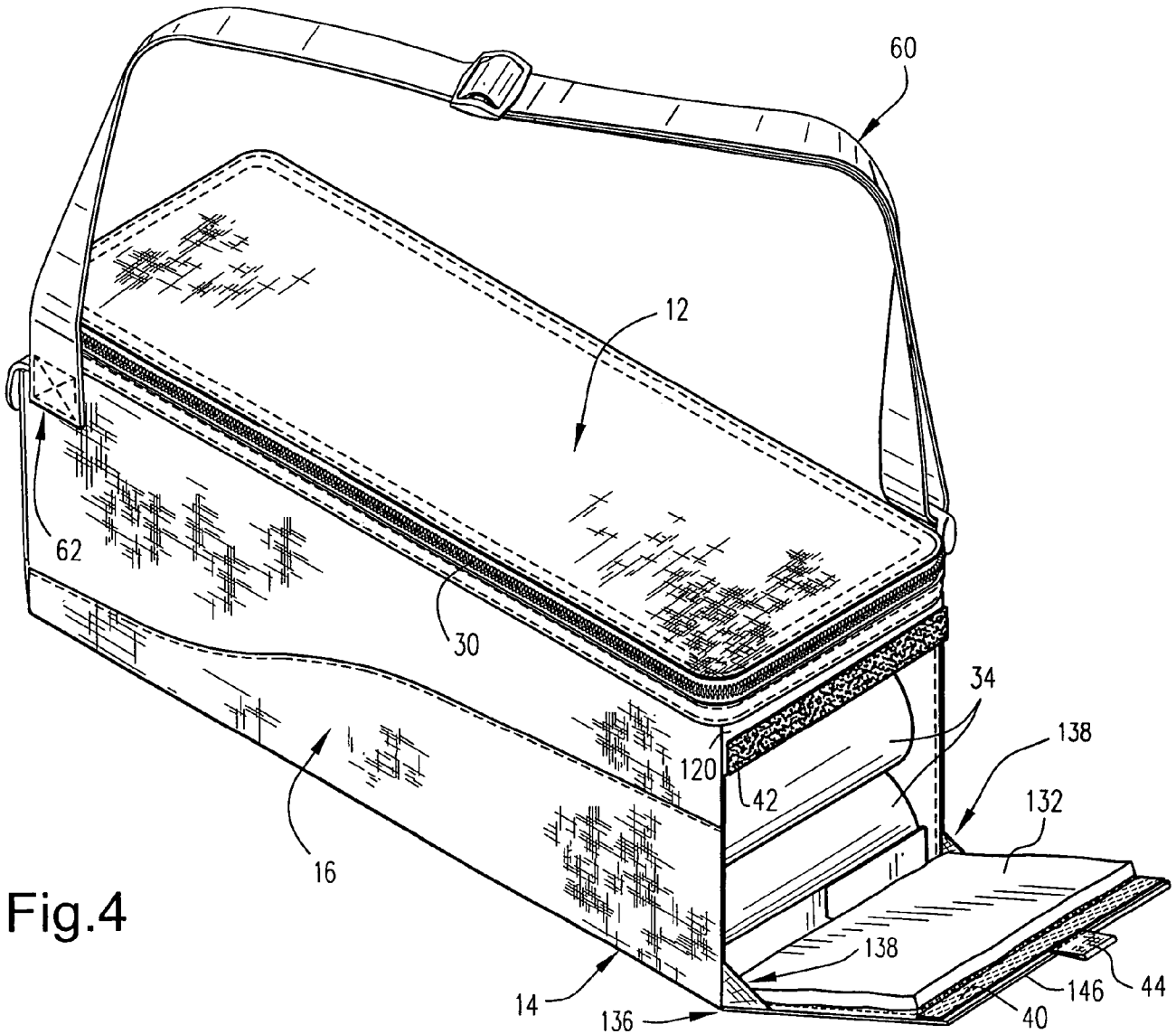
FIG. 4 is a perspective view similar to FIG. 1, showing a second embodiment of a beverage access flap, open for selective removable of a beverage can.
Figure 5:
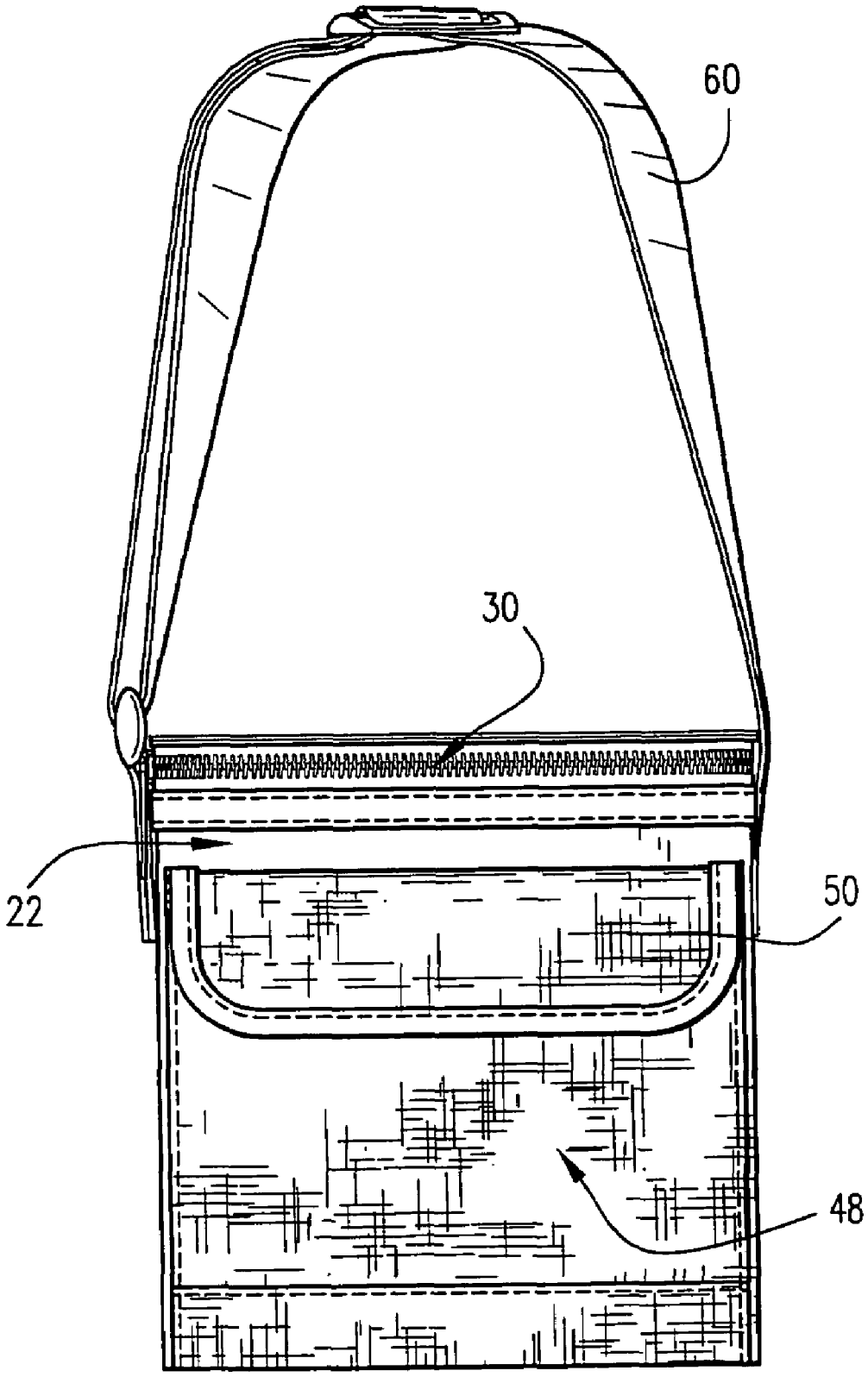
FIG. 5 is a left side elevational view of the embodiment of the FIG. 1.
Figure 6:
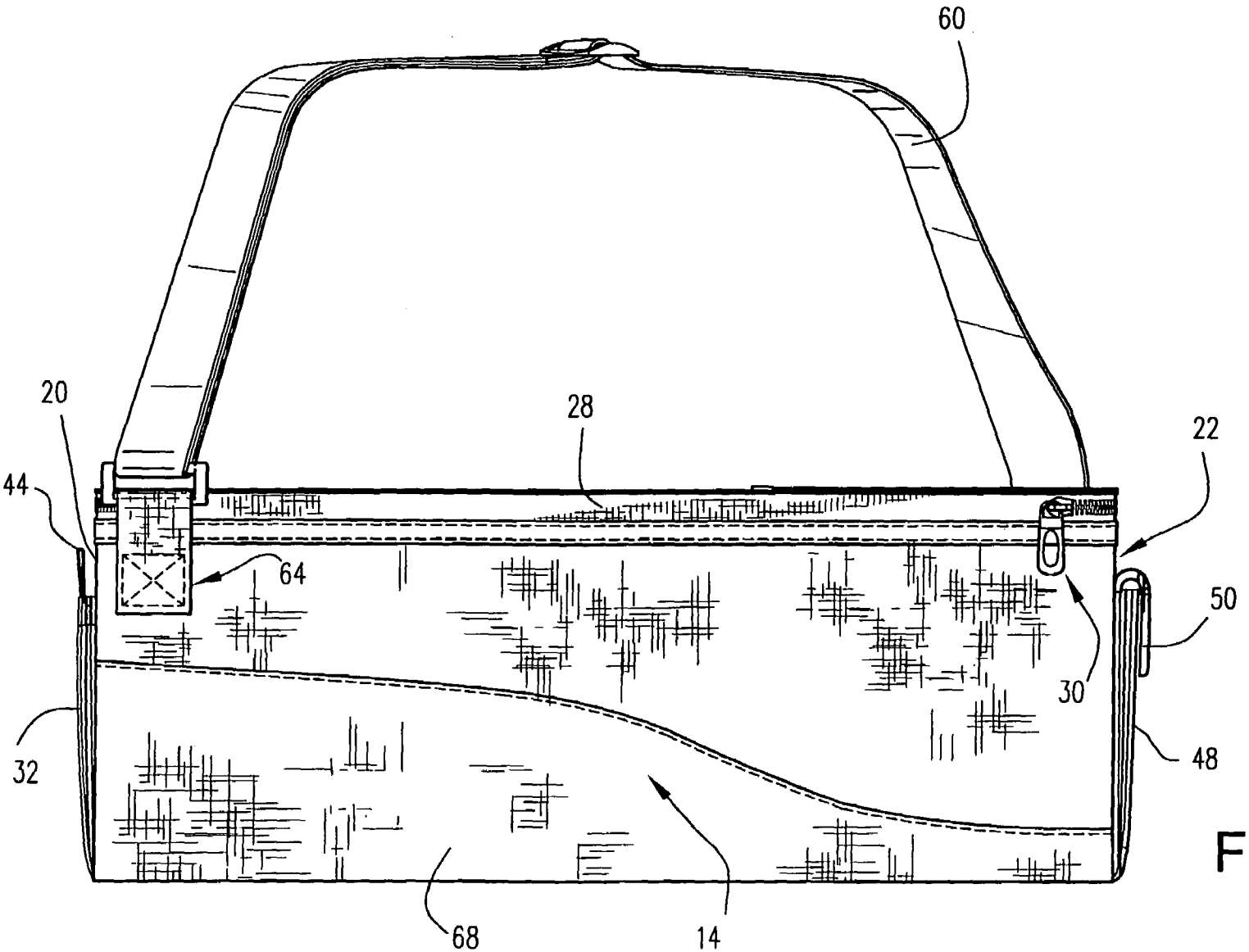
FIG. 6 is a rear elevational view of the tote of FIG. 1.

A beverage access panel 32,132 is provided in at least one of one of the right and left end wall panels 20,22 (the right panel in the illustrated embodiment) to provide selective access to individual beverage containers 34 within box 26 without requiring that the tote 10 be opened, or even that access to the tote lid 12 be possible. Thus, even if the tote is packed for transport with objects disposed on front and rear sides thereof and on top and below, it is nevertheless possible to open the beverage access panel 32,132 and selectively remove individual containerized drinks 34, as shown in FIGS. 3 and 4.

In an exemplary embodiment, the access panel 32,132 is pivotally mounted as at 36,136 at or adjacent bottom wall 14 of the tote. In one embodiment, gussetted side walls 38 are provided to limit displacement of panel 32 when it is pivoted outwardly to provide access to the containerized drink, as shown in FIG. 3. In this embodiment the access panel 32 is relatively thin and rigid and the gussetted side walls 38 extend substantially the full height of the panel 32. In another embodiment, as shown in FIG. 4, panel 132 is an insulated panel, in a manner similar to the side walls 16,18 and the gussetted sides 138 thereof are truncated and are preferably formed from an elastic material to facilitate access to the tote interior. Each of access panels 32,132 preferably includes a rigid or semi-rigid insert or reinforcement to maintain its structural integrity.

A suitable closure is advantageously provided to hold the flap 32,132 in the closed position. In the illustrated embodiment, a Velcro-type hook and fastener material 40,42 is provided respectively on the panel 32,132 and on the end wall panel 120 of the tote to hold the access panel 32,132 closed. A pull tab or loop 44 projects from the free edge 46,146 of the flap 32,132 to facilitate grasping and opening of the panel. In the alternative, a closure flap may be provided to hold panel 32 closed.

In the illustrated embodiment, the other, left end wall 22 of the tote is provided with a dry goods storage pocket which by way of example is a pivoted, side gussetted panel 48 that defines a receptacle with the end wall 22 of the tote. A suitable closure member, such as a closure flap 50 having a closure member, e.g. a Velcro-type hook and loop fastener, snap or magnetic closure, may be provided to hold flap 50 closed. It is to be understood that another closure configuration could be provided in lieu of the flap 50 illustrated.

As noted above, each wall panel of the insulated tote preferably has insulative properties such that heat transfer across the panel is limited. An example of a suitable panel construction is an internal core of foam such as closed cell poly urethane foam. The insulating foam is in turn received between a protective, preferably waterproof layer provided on the interior of the tote and a decorative layer of polymer sheeting, such as nylon sheeting on the exterior of the tote. In order to maintain the soft-sided characteristics of the portable tote of the illustrated embodiment, preferably at least the side and end panels are pliable. In a preferred embodiment, the top panel is also pliable. In this manner the tote structure can be partially or completely collapsed for low profile storage. However, it is preferred that the bottom wall of the tote be not only insulated but also reinforced to ensure that the tote can maintain its structural integrity when supporting heavy contents such as a twelve pack of twelve ounce cans. A relatively rigid base is also preferred due to the elongated tote configuration, to minimize bowing at the mid point of the tote. As will be appreciated, the soft wall configuration of the panels of the illustrated embodiment reduces the weight of the tote and makes the tote more comfortable to carry.

In an embodiment of the invention, an adjustable, flexible carrying strap 60 is provided which can be received over the shoulder or carried by hand. In the illustrated embodiment, a first longitudinal end 62 of the strap is attached to the front wall 16 of the tote and a second longitudinal end 64 of the strap is attached to a rear wall 18 of the tote. It is to be noted that the longitudinal ends of the strap are longitudinally offset with respect to one another along the longitudinal axis of the tote. In the illustrated, presently preferred embodiment, the strap attachments are adjacent the right and left ends of the tote. Surprisingly, this eccentric attachment of the strap provides a stable, manageable suspension for the elongated tote structure that minimizes right to left or front to rear rotation of the tote body. In addition to or as an alternative to the shoulder strap shown, a transport handle may be secured, e.g., to the top panel 12 of the cooler, aligned with the longitudinal axis of the tote. To enhance the aesthetics of the tote, in the illustrated embodiment, a wave swell detail 66,68 is provided along the front and rear walls. The wave swell design may be omitted, however, without departing from the scope of the invention.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In combination, a beverage box and an insulated container, the beverage box comprising:

a parallelepiped shaped beverage can box having a removable dispensing opening;

the insulated container for the beverage box comprising:

insulated side and end wall panels;

a bottom wall panel;

a top wall panel, wherein said top wall panel is secured to at least one of said side and end wall panels, said side, end, top, and bottom end wall panels defining an insulated enclosure volume therebetween, at least a portion of said top wall panel being displaceable with respect to a top edge of said side and end wall panels as a lid panel to provide selective access to said insulated enclosure volume;

an access opening defined in one of said right and left end wall panels for providing access to the enclosure volume without displacing said lid panel;

an access panel for selectively closing said access opening, wherein the removable dispensing opening of the beverage box is disposed proximate to the access opening such that beverage cans disposed in the beverage box are removable through the beverage box opening and the access opening.

2. The combination beverage box and insulated container of claim 1, wherein the lid panel has a length generally corresponding to said length of said side wall panels and a width generally corresponding to a width of said end wall panels.

3. The combination beverage box and insulated container of claim 1, wherein the access panel is pivotally attached adjacent said bottom wall panel and had a free edge remote from the pivotal attachment.

4. The combination beverage box and insulated container of claim 3, wherein the free edge is detachably secured to the respective end wall panel.

5. The combination beverage box and insulated container of claim 3, further comprising gusseted sidewalls interconnecting said access panel to at least one of the respective end wall panel and the side wall panels.

6. The combination beverage box and insulated container of claim 5, wherein the gusseted sidewalls comprise an elastic material.

7. The combination beverage box and insulated container of claim 1, further comprising a carrying strap having first and second longitudinal ends, the first longitudinal end being secured to a first portion of the container and the second longitudinal end being secured to a second portion of the container, wherein the first portion and the second portion are in a spaced apart orientation.

8. The combination beverage box and insulated container of claim 7, wherein the first portion comprises the front panel and the second portion comprises the back panel.

9. The combination beverage box and insulated container of claim 7, wherein the first longitudinal end is offset from the second longitudinal end along the longitudinal axis of the, container such that the first and second longitudinal ends are each laterally offset from a plane perpendicular to and passing through a longitudinal midpoint of the front and rear panels.

10. The combination beverage box and insulated container of claim 1, further comprising a fastener for detachably securing said access panel in a position substantially closing said access opening.

11. The combination beverage box and insulated container of claim 10, wherein the fastener comprises a hook and loop type fastening material.

12. The combination beverage box and insulated container of claim 10, wherein the fastener comprises a mechanical fastener.

13. The combination beverage box and insulated container of claim 1, wherein the access panel comprises insulation.

14. The combination beverage box and insulated container of claim 1, wherein the top wall panel, side wall panels, and end wall panels comprise a pliable material.

15. A method of inserting a beverage box into an insulated container comprising:

providing the insulated container comprising:

insulated side and end wall panels;

a bottom wall panel;

a top wall panel, wherein the top wall panel is secured to at least one of said side and end wall panels, said side, end, top, and bottom end wall panels defining an insulated enclosure volume therebetween, at least a portion of said top wall panel being displaceable with respect to a top end of said side and end wall panels as a lid panel to provide selective access to said insulated enclosure volume;

an access opening defined in one of said right and left end wall panels for providing access to the enclosure volume without displacing the lid panel; and an access panel for selectively closing said access opening;

positioning the lid panel so as to provide access to the insulated enclosure volume from an exterior of the insulated container; and positioning the beverage box within the insulated enclosure volume such that the removable dispensing opening of the beverage box is disposed proximate to the access opening of the insulated container, wherein the beverage box comprises a parallelepiped shape beverage can box and a removable dispensing opening.

16. The method of claim 15, further comprising moving the access panel from a first position to a second position, wherein the second position allows for access to the beverage box in the insulated container.

17. The method of claim 16, further comprising accessing a beverage can in the beverage box and removing the beverage can from the insulated container through the access opening.

18. The method of claim 17, further comprising the step of returning the access panel from the second position to the first position, wherein the first position prevents access to the beverage box through the access opening.

19. The method of claim 18, wherein the access panel automatically moves towards the second position from the first position once a force is no longer applied to the access panel.

20. The method of claim 16, further comprising removing the removable dispensing opening through the access opening of the insulated container.

21. The method of claim 15, further comprising the step of removing the removable dispensing opening of the beverage box prior to positioning the beverage box within the insulated enclosure volume.

22. The method of claim 15, further comprising the step of positioning the lid panel so as to prevent access to the insulated enclosure volume from an exterior of the insulated container by way of the top wall panel after the beverage box is positioned within the insulated enclosure volume.

* * * * *